United States Patent [19]

Hanak

[11] 4,289,067

[45] Sep. 15, 1981

[54] PRESS FOR RENDERING FATTY BONES

[75] Inventor: Gyula Hanak, Brussels, Belgium

[73] Assignee: PB Gelatines, Brussels, Belgium

[21] Appl. No.: 44,284

[22] Filed: May 31, 1979

[30] Foreign Application Priority Data

May 31, 1978 [FR] France ..... 78 16163

[51] Int. Cl.[3] ..... B30B 9/12

[52] U.S. Cl. ..... 100/117; 100/98 R; 100/150

[58] Field of Search ..... 100/117, 127, 129, 145, 100/150, 98 R

[56] References Cited

U.S. PATENT DOCUMENTS

| | | | |
|---|---|---|---|
| 3,092,017 | 6/1963 | French et al. | 100/117 X |
| 3,398,676 | 8/1968 | Theobald et al. | 100/37 |
| 3,398,677 | 8/1968 | Theobald et al. | 100/37 |
| 3,518,936 | 7/1970 | Bredeson | 100/117 |
| 4,024,168 | 5/1977 | Homann et al. | 100/117 X |

*Primary Examiner*—Chris K. Moore

*Attorney, Agent, or Firm*—Millen & White

[57] ABSTRACT

A multistage continuous rotary screw press assembly with the helical or spiral collars, vanes or ribs of each stage within the casing separated from those of an adjacent stage in the direction of material feed through the casing by a transition zone in which fixed material impingement elements, for example, knives, are mounted for dividing the material as it is expressed from one stage to the next adjacent stage in the material feeding direction.

12 Claims, 4 Drawing Figures

PRESS FOR RENDERING FATTY BONES

BACKGROUND OF THE INVENTION

The invention is directed to an improved press for rendering fatty bones in order to obtain rendered bones of low fat content suitable for the production therefrom of gelatin and also glue or animal meal.

Fatty bones are, for example, slaughter house or butcher's shop offal containing meat and fats besides bones. Loads of fatty bones supplied vary greatly and their content in soft substances (meat, fats, skins . . . ) can range between 0 and 40–50% according to their source, the mean content being about 15%. Due to their nature fatty bones supplied cannot be homogenized beforehand. They must be used as such. Fatty bones are usually treated in order to take off the major part of fats and non-collagenous proteinacious material and obtain the desired particle size range. Most often the bones are first sorted out for eliminating foreign substances such as pieces of iron or plastic material and are afterwards sent to a prebreaker and a breaker. The broken bones are heated by steam to a temperature of about 90° to 95° C. and charged in a press in order to recover a solid cake constituted in major part by bones and a liquid constituted by molten fats, water-soluble substances and in some cases, bone powder. The separated liquid is treated in order to recover fats and proteinous substances. The bones are dried and optionally treated for the production of gelatin.

It has been proposed to use multistage continuous screw presses. These presses are constituted by a cylindrical cage made out of wire netting, perforated plates or, most often longitudinally extending slats. In the cage or casing is located a drive arbor or tube on which is secured in each stage a continuous screw collar, vane or rib, with a thread configuration. The internal diameter of said screw collar increases in the direction of feed circulation of the treated bones and the outer diameter of the thread of the screw collar is constant and slightly less than the inside diameter of the cage so that the screw collar can freely rotate in the cage. Between two successive stages, there is disposed a threadless or transition zone formed by concentrically mounting on the drive tube two cylindrical sleeves or surface portions integral with one another. One of the sleeves is fixed to the continuous screw collar of the preceding stage and its outer diameter is equal to the largest inner diameter of the screw collar of that preceding stage. The other sleeve is fixed to the continuous screw collar of the next stage and its outer diameter is equal to the smallest inner diameter of the screw collar of that next stage. The driving tube also supports a threadless zone provided by a single cylindrical sleeve portion located at the outlet of the last stage of the press. The press may include two to six stages, but more often four. Such presses are described for example in U.S. Pat. Nos. 3,398,677 and 3,398,678.

These presses are currently used for rendering fish wastes, separating fat from cracklings in crude fats, extracting oil from oleaginous seeds such as soja, peanuts, etc. They can also be used for rendering slaughter house or butcher's offal containing a high proportion of soft substances (meat, fats, skins, etc.). But when treating fatty bones containing less than 20% of soft substances, the bones do not move forward regularly in the press, thus causing clogging with resultant jamming or breaking of the press.

In order to avoid such jamming or breaking, presses containing two driving tubes were proposed with the thought that the friction between the two bone cakes would induce the treated bones to move forward. However, as shown by test, such jammings continued with the result that the two drive tubes became twisted and were drawn aside out of alignment.

A rotating knife penetrating between the threads of the screw was also tried for it was believed that it would force the cake to move forward. However, the knife was often carried away by the excessively dense cakes, resulting in the knife being broken, or twisted or damaging the thread formation of the screw.

SUMMARY OF THE INVENTION

The present invention relates to an improved multistage continuous screw press usable for rendering bones containing less than 20% of soft substances without jamming or breaking of the press. The improved press is obviously also usable for rendering fat containing higher percentages of soft substances.

The present invention relates to a multistage continuous screw press constituted by a cylindrical cage or casing in which is located a drive arbor or tube on which, in each stage, is secured a continuous screw collar, the inside diameter of which increases in the direction of feeding circulation of the treated product and the outer diameter of which is slightly less than the inside diameter of the cage and on which, between two successive stages, is located a threadless transition zone formed by two cylindrical surface portions or sleeves integral with one another. One of the sleeves is fixed to the continuous screw collar of the preceding stage and has an outer diameter equal to the greatest inner diameter of the screw collar of the preceding stage. The other sleeve is fixed to the continuous screw collar of the next stage and has an outer diameter equal to the smallest inner diameter of the continuous screw collar of the next stage. An important feature of the present invention is in connection with the area of the threadless zones where there are provided impingement elements in the form of at least two L-shaped knives arranged in such a manner that the branch of the L-shaped portion fixed to the cage is at the level of the sleeve portion having the greatest outer diameter and that the perpendicular branch portion is at the level of the sleeve portion having the smallest diameter.

Thus, it is an object of the invention to provide the above arrangement of impingement devices or knives to cause the cake to move forward in regular fashion following the thread of the screw without any risk of breaking or twisting the knives.

Three to six knives in each transition zone can be used but it was found that two knives are sufficient in most cases. They are generally regularly spaced in a cross-section of the cage. When there are two knives they are preferably on the same diameter, preferably along a horizontal diameter portion. When there are three knives they are disposed at an angle of 120°. The two branches of the knife are often of different length, with the longest branch preferably fixed to the cage. The best results are obtained when the gap between the knife and the outer part of the threadless zone is equal to about 5 mm. The end of the branch fixed to the cage and the edge of the perpendicular branch facing the feeding or upstream end of the press are preferably bevelled. The knives are preferably fastened in slots cut out in the cylindrical cage. They can be welded or riveted but they are preferably held by screws in order to be easily replaced.

The description given hereunder of an embodiment of the press of the invention will allow to understand better the invention, by reference to the accompanying drawing in which.

Figure 1:
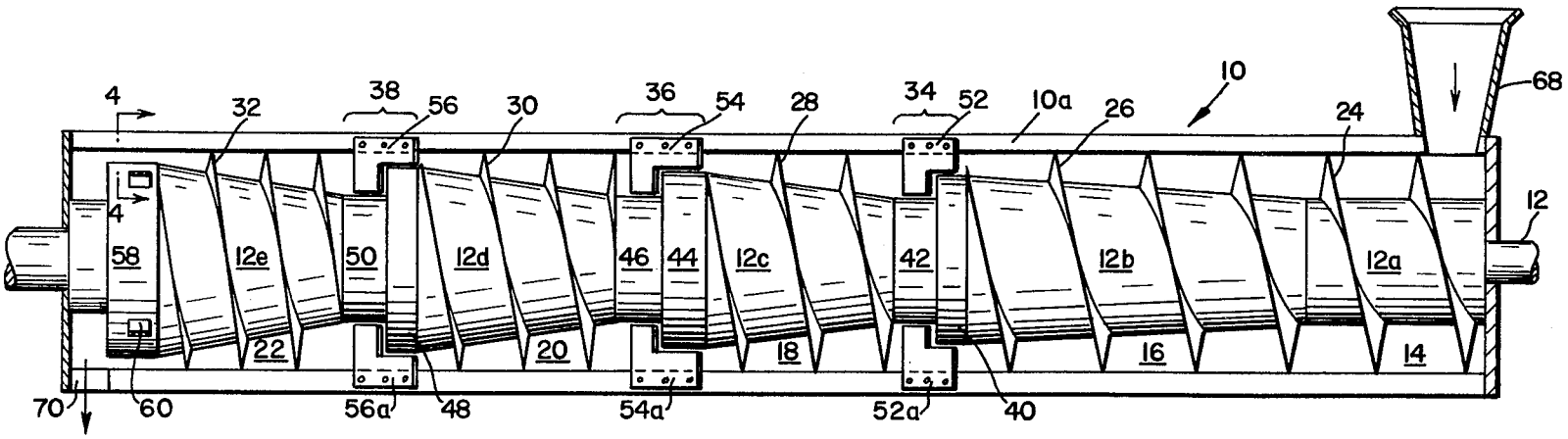
FIG. 1 is a longitudinal view with half the casing removed to illustrate the multistage screw and knife arrangement therein.
Figure 4:
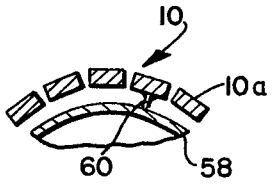
FIG. 4 is a fragmentary detail in section on line 4—4 of FIG. 1 to show the slat construction of the casing.
Figure 3:
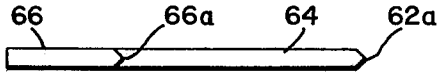
FIG. 3 is a further enlarged plan view of one of the knives.

The press assembly includes a cage or casing 10 formed of longitudinal slats 10*a* suitably assembled and mounted and in which is located a drive arbor or tube 12 which is suitably mounted and coupled to a motor (not shown). The press assembly includes an inlet compartment 14 and four screw stages 16, 18, 20 and 22. The length of the stages decreases in the direction of feed circulation of the product, with stage 16 being the longest stage and stage 22 being the shortest. In the inlet compartment 14, drive tube 12 supports a continuous screw collar 24 having a constant inside diameter in complement to the diameter of arbor portion 12*a*. In the stages 16, 18, 20 and 22, the drive tube 12 supports continuous screw collars 26, 28, 30 and 32, respectively, the inside diameter of which increases in the direction of circulation of the product in complement, respectively, to the inclined arbor portions 12*b*, 12*c*, 12*d*, 12*e*. The outer diameter of the continuous screw collars 24, 26, 28, 30 and 32 is constant and slightly smaller than the inside diameter of the cage 10 in order that the continuous screw collars can freely rotate in the cage. Between the stages 16 and 18, 18 and 20 and 20 and 22 are threadless transition zones 34, 36 and 38, that is, zones without screw collars therein. Each zone is constituted by two cylindrical surface or sleeve portions: 40 and 42 for zone 34, 44 and 46 for zone 36, 48 and 50 for zone 38. In zone 34, for example, sleeve 40 has a diameter equal to the largest internal diameter of continuous screw collar 26 and sleeve 42 has a diameter equal to the smallest internal diameter of continuous screw collar 28. The knives 52, 52*a*, 54, 54*a*, 56, 56*a* are fixed to the wall of cage 10 within the longitudinal extent of the threadless zones 34, 36 and 38, respectively. According to the embodiment of the invention shown, two knives are disposed on a horizontal diametral portion in each zone. A sleeve or surface portion 58 is located at the outlet end of the last stage 22 with a diameter equal to the largest internal diameter of the screw collar 32. Four breaker clips 60 are equidistantly fixed to the casing 10 around the sleeve portion 58 at angles of 90° relative to one another and at angles of 45° relative to a horizontal line for the purpose of breaking the issuing cake and facilitating its forward movement.

Figure 2:
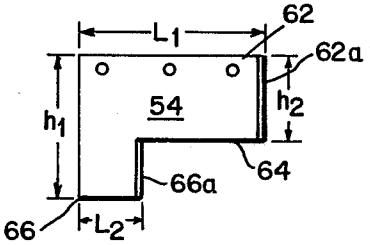
FIG. 2 is an enlarged side elevation of one of the knives.

The knives are usually formed of steel and are L-shaped as shown and with reference to FIG. 2, the relative dimensions of the branches may vary from one stage to another. For example, the knives in a press assembly of 350 to 450 cm in length and a casing of 65 to 55 cm in diameter may have the following range of dimensions, and the axial extent of the transition zones as well as relative radial extents of the cylindrical surface or sleeve portions will be dimensioned accordingly to accommodate the knives in each zone with proper clearance:

| Knife | (52) | (54) | (56) |
|---|---|---|---|
| $L_1$(mm) | 155 to 190 | 200 to 290 | 165 to 200 |
| $L_2$(mm) | 70 to 110 | 70 to 105 | 70 to 100 |
| $h_1$(mm) | 105 to 115 | 95 to 110 | 75 to 85 |
| $h_2$(mm) | 165 to 175 | 155 to 165 | 155 to 165 |

The thickness of the knives is variable and may, for example, be of the order of 10 mm. As shown in FIG. 1, each of the knives is mounted in its respective zone in similar manner and reference will be made in FIG. 2 for a description of the mounting of knife 54. Thus, the elongate edge 62 is apertured for mounting in a slat or runs in one of the slats 10*a* by means of screws or like fastening means. This will locate the inner edge 62 in overlapping position relative to the large diameter cylindrical surface portion 44 with suitable clearance and with the bevelled edge 62*a* facing the material issuing from stage 16. The lower edge 66 of the perpendicular branch of the knife will be in overlapping relation to the smaller diameter surface 46 with suitable clearance and with the bevelled edge 66*a* alone facing the material issuing from stage 16.

Thus, the material is conveyed and introduced in conventional manner from a hopper 68 to the upstream chamber 14 of the screw press assembly and is progressed through the press to the collection and discharge assembly for delivery through opening 70 for ultimate conveyance and disposition as desired. During progress through the press assembly, the fluid and fines expressed through the slat apertures will be collected in known manner. With the screw collar in such stage having increasing internal diameter from the mounting on the respective inclined arbor portions, the material is effectively compressed and this is augmented by the egress end, and the increased maximum inner diameters of the screw collars in such stages as they approach the comparable diameters of the larger cylindrical surface portions in an adjacent transition zone. The material is thus subjected to progressively higher pressure in each stage but with some reduction in pressure and reorientation as it passes through each transition zone between adjacent stages. This results from the offset positioning of the cylindrical surface portions which may be formed of sleeves integrally attached to one another or as formations on the arbor portions; and the bevelled edges of the knives, in each transition zone serve to divide the material as it passes from one upstream stage to the next adjacent downstream stages, with elimination of jamming of the material and breakage of the knives on other material impingement devices in the transition zones. Upon egress of the processed material, the clips so further divide the material prior to discharge through the end aperture 70.

What is claimed is:

1. In a multistage continuous rotary press assembly, including a cylindrically shaped casing and including a rotary drive arbor passing therethrough and supported at the ends thereof and carrying a continuous screw collar in each stage with the outer diameter of the screw collar in each stage being slightly less than the inside diameter of the casing, and with the inner diameter of the screw collar in each stage increasing in the direction of feeding circulation of the product material being treated, said press assembly further comprising: said screw collar having a shape to define transition zones between adjacent pair of stages in the area between the end of the screw collar in an upstream stage portion and the beginning of the screw collar in the next succeeding downstream stage portion; material impingement means disposed within each transition zone, said material impingement means having upstream edges oriented for dividing material entering the transition zone from the adjacent upstream stage as it passes through the transition zone to the next adjacent downstream stage, said impingement means comprising first impingement portions located in the transition zones at the upstream stage portions and having said upstream edges, and second impingement portions located spaced from the upstream stage portion in the transition zones at the downstream stage portions and having said upstream edges.

2. In the press assembly of claim 1, wherein the impingement means in each zone comprises at least a pair of fixed peripherally spaced knives in each transition zone with the bevelled knife edges thereof facing the upstream stage for dividing the material issuing therefrom.

3. In the press assembly of claim 1, wherein each transition zone presents radially spaced cylindrical surface portions inwardly spaced from the casing and rotating with the arbor and wherein the impingement means is attached to the casing and complementally spaced for generally follow the contour of the spaced surface portions in each transition zone.

4. In the press assembly of claim 3, wherein the impingement means comprises at least a pair of fixed peripherally spaced knives with bevelled knife edges facing the upstream stage for dividing material issuing therefrom.

5. In a press assembly as in claim 4 wherein each of said knives is L-shaped to have an inwardly spaced branch and an outwardly spaced branch, and each of said branches are located in juxtaposition to each radially spaced cylindrical surface portions in each of said transition zones.

6. In the press assembly of claim 1, wherein each transition zone comprises radially spaced cylindrical surface portions inwardly of the casing and rotating with the arbor, with the upstream larger surface portion having a diameter substantially equal to the largest inner diameter of the screw collar in the adjacent upstream stage and with the downstream smaller diameter surface portion substantially equal to the smaller inner diameter of the screw collar of the adjacent downstream stage.

7. In a press assembly as in claim 5 wherein said impingement means comprises peripherally spaced L-shaped knives located in each transition zone, each of said knives having a radially inwardly spaced branch and a radially outwardly spaced branch extending horizontally to overlap the larger diameter surface portion of a transition zone between adjacent stages with a clearance therebetween, said radially inwardly spaced branch overlapping the smaller diameter surface portion of the transition zone with a clearance therebetween, and each upstream edge of each of said branches of said knives having bevelled edges for dividing material impinging thereon from adjacent upstream stages.

8. In the press assembly of claim 7, wherein the outwardly spaced branch of each L-shaped knife is fixed to the casing in diametral mirror opposition to a second knife in each zone.

9. In the press assembly of claim 1, wherein the arbor in each stage is of progressively increasing diameter in the downstream direction of feeding circulation of the material to place the maximum inside diameter of the screw collar in each zone at the upstream entry to each zone, and wherein each transition zone includes integral radially spaced cylindrical sleeve portions with the larger diameter sleeve portion mounted adjacent the largest inner diameter portion of the screw collar in the adjacent upstream stage and with the smaller diameter sleeve portion mounted adjacent the smallest inner diameter of the screw collar in the adjacent downstream stage.

10. In the press assembly of claim 9, wherein the impingement means comprises at least two L-shaped knives substantially diametrically spaced from one another in each zone with the longer branch attached to the casing and presenting a bevelled edge to material issuing from the upstream stage and with the shorter branch juxtaposed to the smaller diameter sleeve portion and presenting a bevelled edge to material issuing over the larger diameter sleeve portion in the said zone.

11. A multiple stage continuous rotary press assembly comprising:

a cylindrically shaped casing;

a rotary drive arbor supported at the ends thereof and extending through said casing for rotational movement therein;

a continuous screw collar supported on said rotary drive arbor, said screw collar having a shape for defining a plurality of stages within said casing and having an increasing inner diameter within each of said plurality of stages in the direction of flow of material, said screw collar additionally defining transition zones having upstream and downstream stage portions located between adjacent ones of said plurality of stages; and material impingement means disposed within each of said transition zones and having upstream facing edges positioned for dividing material entering each of said transition zones from an adjacent upstream stage as said material passes from the upstream stage to a next adjacent downstream stage, said impingement means further comprising first impingement portions located in each transition zone at the upstream stage portions and having said upstream facing edges, and second impingement portions located spaced from the upstream stage portion in the transition zones at the downstream stage portions and having said upstream facing edges.

12. In a multiple stage continuous rotary press assembly of the type including a cylindrically shaped casing, a rotary drive arbor supported at the ends thereof and extending through said casing for rotational movement therein, a continuous screw collar supported on said rotary drive arbor, said screw collar having a shape for defining a plurality of stages within said casing and having an increasing diameter within each of said plurality of stages in the direction of flow of material, an improvement comprising said screw collar shaped for defining transition zones located between adjacent ones of said plurality of stages, each of said transition zones presenting radially spaced first and second cylindrical surface portions inwardly spaced from the casing and rotating with the arbor, said first cylindrical surface portions having a diameter corresponding to the diameter of the screw collar at each upstream end of each stage, and said second cylindrical surface portions having a diameter corresponding to the diameter of the screw collar at each downstream end of each stage; and impingement means disposed within each of said transition zones and having upstream facing edges positioned for dividing material entering each of said transition zones from an adjacent upstream stage as said material passes from the upstream stage portion to a next adjacent downstream stage portion, said impingement means comprising at least a pair of fixed peripherally spaced L-shaped knives, each of said knives having a radially upwardly spaced branch and a radially outwardly spaced branch extending horizontally to overlap the larger diameter surface portion of each transition zone with a clearance therebetween, said radially upwardly spaced branch overlapping the smaller diameter surface portion of the transition zone with a clearance therebetween, and each upstream edge of each of said branches of said knives having bevelled edges for dividing material impinging thereon from adjacent upstream stages.

* * * * *